US011403918B2

(12) United States Patent
Denham et al.

(10) Patent No.: US 11,403,918 B2
(45) **Date of Patent: *Aug. 2, 2022**

(54) SYSTEM AND METHOD OF PROVIDING WAGERING OVER A COMPUTERIZED NETWORK

(71) Applicant: Wamba Technologies, LLC, a Limited Liability Company of Nevada, Scottsdale, AZ (US)

(72) Inventors: Gary Martin Denham, Palm Springs, CA (US); Bruce Alan Evenson, Ramona, CA (US); Jason P. Webb, South Jordan, UT (US)

(73) Assignee: WAMBA TECHNOLOGIES, LLC, A LIMITED LIABILITY COMPANY OF NEVADA

( * ) Notice: Subject to any disclaimer, the term of this patent is extended or adjusted under 35 U.S.C. 154(b) by 0 days.

This patent is subject to a terminal disclaimer.

(21) Appl. No.: 16/865,238

(22) Filed: May 1, 2020

(65) Prior Publication Data

US 2020/0258353 A1 Aug. 13, 2020

Related U.S. Application Data

(63) Continuation of application No. 15/650,232, filed on Jul. 14, 2017, now Pat. No. 10,679,463, which is a continuation of application No. 14/491,993, filed on Sep. 20, 2014, now Pat. No. 10,424,160.

(60) Provisional application No. 61/880,365, filed on Sep. 20, 2013.

(51) Int. Cl.
*A63F 9/24* (2006.01)
*G07F 17/32* (2006.01)

(52) U.S. Cl.
CPC ..... *G07F 17/3262* (2013.01); *G07F 17/3225* (2013.01); *G07F 17/3244* (2013.01)

(58) Field of Classification Search
None
See application file for complete search history.

(56) References Cited

U.S. PATENT DOCUMENTS

| | | | |
|---|---|---|---|
| 7,637,810 | B2 | 12/2009 | Amaitis et al. |
| 8,064,889 | B2 | 11/2011 | Griswold et al. |
| 8,087,999 | B2 | 1/2012 | Oberberger et al. |
| 8,088,000 | B2 | 1/2012 | Ginsberg et al. |

(Continued)

FOREIGN PATENT DOCUMENTS

| | | | |
|---|---|---|---|
| WO | 0247042 | A1 | 6/2002 |
| WO | 2005107907 | A2 | 11/2005 |

(Continued)

*Primary Examiner* — Sunit Pandya
(74) *Attorney, Agent, or Firm* — Jason P. Webb; Pearson Butler

(57) ABSTRACT

A system and method of providing wagering over a computerized system. The system includes a computerized multi-player game. The game includes an integral game mechanics module for providing a game-play session over a computerized network. The game mechanics module is in real-time communication with a wagering module and therethrough the wagering module automatically receiving real-time game event information. The game mechanics module provides a wagering option to a player in real-time that is selectable by a game-play action.

23 Claims, 8 Drawing Sheets

(56) References Cited

U.S. PATENT DOCUMENTS 8,337,300 B2 * 12/2012 Bowers ..... G07F 17/3267 463/25
8,382,581 B2 2/2013 Fargo
8,414,387 B1 4/2013 Paradise et al.
2003/0228901 A1 * 12/2003 Walker ..... G07F 17/3244 463/25
2006/0240894 A1 10/2006 Andrews
2006/0287097 A1 12/2006 Moshal
2007/0077994 A1 4/2007 Betteridge
2007/0135208 A1 6/2007 Betteridge
2007/0167239 A1 7/2007 O'Rourke
2007/0222150 A1 9/2007 Wright et al.
2007/0265092 A1 11/2007 Betteridge
2008/0033734 A1 2/2008 Carry
2008/0064488 A1 * 3/2008 Oh ..... G07F 17/3295 463/25
2008/0318655 A1 12/2008 Davies
2009/0023489 A1 * 1/2009 Toneguzzo ..... G07F 17/3255 463/16
2010/0029377 A1 * 2/2010 Canterbury ..... G07F 17/32 463/25
2010/0255900 A1 * 10/2010 Ansari ..... G07F 17/3223 463/25
2010/0267449 A1 * 10/2010 Gagner ..... G06F 3/0488 463/30
2011/0081959 A1 * 4/2011 Ansari ..... G07F 17/32 463/16
2011/0212766 A1 * 9/2011 Bowers ..... G07F 17/3244 463/25
2012/0034961 A1 2/2012 Berman et al.
2012/0302329 A1 11/2012 Katz et al.
2014/0087848 A1 * 3/2014 Kosta ..... G07F 17/3227 463/25

FOREIGN PATENT DOCUMENTS

WO 2007044466 A2 4/2007
WO 2007067700 A2 6/2007
WO 2008058122 A2 5/2008
WO 2008108778 A1 9/2008
WO 2009063335 A2 5/2009

* cited by examiner

SYSTEM AND METHOD OF PROVIDING WAGERING OVER A COMPUTERIZED NETWORK

CROSS-REFERENCE TO RELATED APPLICATIONS

This application is a Continuation Application of, under 35 U.S.C. § 120, and claims priority to, under 35 U.S.C. § 120, U.S. Continuation application Ser. No. 15/560,232, entitled SYSTEM AND METHOD OF PROVIDING WAGERING OVER A COMPUTERIZED NETWORK, by Gary Martin Denham et al., filed on Jul. 14, 2017. This invention claims priority therethrough, under 35 U.S.C. § 120, to the U.S. Pat. No. 10,424,160 to Gary Martin Denham et al. filed on Sep. 20, 2014 which is incorporated by reference herein. This invention additionally claims priority therethrough, under 35 U.S.C. § 120, to the U.S. Provisional Patent Application No. 61/880,365 to Gary Martin Denham et al. filed on Sep. 20, 2013 which is incorporated by reference herein.

BACKGROUND OF THE INVENTION

Field of the Invention

The present invention relates to video game platforms, specifically to a method and system of providing wagering over a computerized network.

Description of the Related Art

There are many types of gambling and many of these are played online. These types of gambling include card games (e.g. variations on poker), dice games (e.g. craps), sports/race betting (e.g. betting on outcomes of football, soccer, basketball, baseball games, and horseracing), randomization machines (e.g. slot machines, pachinko), and lottery style games (e.g. lotteries, bingo). Gambling is a major industry around the world and is the subject of government regulation and scrutiny. The proliferation of online gambling has expanded the scope and difficulties for regulators to manage and control when, where and how gambling occurs.

An online game is a video game that is played over some form of computer network. This network is usually the internet or equivalent technology, but games have always used whatever connection technology was current: modems before the Internet, and hard wired terminals before modems. The expansion of online gaming has reflected the overall expansion of computer networks from small local networks to the internet and the growth of internet access itself. Online games can range from simple text based environments (e.g. MUDS) to games incorporating complex graphics and virtual worlds populated by many players simultaneously (e.g. MMORPGs, team-based first person shooters, social media games). Many online games have associated online communities, making online games a form of social activity beyond single player games.

Some improvements have been made in the field. Examples of references related to the present invention are described below in their own words, and the supporting teachings of each reference are incorporated by reference herein:

U.S. Pat. No. 8,414,387, issued to Paradise et al., discloses a system that includes a third party game server, a plurality of third party game instances and a transactional server. The third party game server provides data related to a third party game. Each of the third party game instances is in communication with and receiving game data from the third party gaming server. Additionally, each third party game instances includes a peer-wagering module to receive a wager amount from a player associated with the corresponding third party game instance. Each third party game instance is associated with an online gaming competition and each player is participating in the online gaming competition. The transactional server receives the wager amount from each peer-wagering module. The transactional server secures previously deposited funds associated with each of the associated corresponding players. The fund amount is equal to the respective wager amount. Related apparatus, systems, techniques, and articles are also described.

U.S. Patent Application Publication No.: 2012/0302329, by Kats et al., discloses a system and methods provided for effecting user experience in an electronic game environment through use of virtual currency or vCoins. In a multi-level game, the systems and methods include memory for storing information on game play, the information including input received from the user, information relating to levels within the multi-level game and game display information for output to the user. A processor is coupled to the memory for generating game play information, preferably including game play with virtual money. The virtual money is acquired through game play or cash purchase. The virtual money is convertible into a non-cash good comprising advancement to another level within the game.

U.S. Patent Application Publication No.: 2012/0034961, by Berman et al., discloses computer implemented gaming methods are provided that include the identifying a plurality of securities to participate in a race; computing odds at an open of the race for at least one type of bet for each of the plurality of the identified securities; publishing using at least one computing device details of the race; generating a visualization of the race, the visualization comprising a plurality of participants each representing an identified security; determining a price of each of the plurality of securities at a start of the race and at least once during a running of the race; and updating the visualization of the race to reflect a change in the price of at least one of the securities in the race.

U.S. Patent Application Publication No.: 2008/0064488, by Oh, discloses a system and method are provided for facilitating wagering by a user on a game of skill. The system can include a gaming network server, and a user gaming device. The user gaming device may include a display device, an input device, and a communications device, the communications device being operable to communicate with the gaming network server, and the user gaming device being configured to allow the user to participate in a game of skill against at least one opponent. The system also includes a wagering server, wherein the wagering server is configured to have the capability to accept a wager from the user gaming device or from the gaming network server.

U.S. Patent Application Publication No.: 2008/0033734, by Carry, discloses a business model and process for conducting, facilitating, and enforcing negotiated wagering agreements between two or more video game players [Players] over the Internet; hereafter referred to as The Confirming Server or The Web-site. The Confirming Server allows owners of video game consoles with online gameplay capability including its library of online games, computer software games playable online, and online board game players (either free or using a pay-site) in remote locations communicating over their personal computer devices and/or online game playing feature of their personal video game console to negotiate and enforce the terms of a wagering, loser-pays-winner, agreement that is determined upon the reported outcome of their anticipated gaming-competition [the Gaming Event]. The actual Gaming Event is played and occurs external to and independent of The Confirming Server.

The inventions heretofore known suffer from a number of disadvantages including but not limited to being slow, difficult to use, difficult for user's to interact with, failing to promote additional use, failing to generate tax dollars, failing to give game developers control over wagering processes applied to their games, failing to provide additional revenue streams to game developers, requiring too many steps to setup, requiring computer expertise to setup, being vulnerable to simple hacks/scripts/packet sniffers/etc., diluting/bifurcating brand strength, being subject to system/program incompatibilities, not being automated, not automatically complying with requirements/laws/etc., not providing an intense/fun/engaging user experience, and/or not providing an intense/fun/engaging spectator experience.

What is needed is a method and system for providing wagering over a computerized network that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available methods and systems for providing wagering over a computerized network. Accordingly, the present invention has been developed to provide an effective and efficient method and system for providing wagering over a computerized network.

According to one embodiment of the invention, there is a method of providing wagering over a computerized network. The method may include the step of providing, over a computerized network, a computerized multi-player game that may have an integral game mechanics module in communication with an integral wagering module that may have a data storage device for storing wager characteristics. The method may include providing control of a plurality of physics-based game objects to players through the game mechanics module and during a game-play session, wherein control of the plurality of physics-based game objects may influence game-play. The method may also include the step of altering, by operation of a processor, a wager characteristic in response to occurrence of a predefined game mechanics event tracked by the game mechanics module during the game-play session. The altering step may include the step of validating a wager.

The method may include the step of automatically calculating taxation of a result of a wager session determined by the wagering module. The method may include the step of automatically collecting and paying taxes from a user account within the multiplayer game. The method may include displaying wager information on the same screen as game-play. The method may include the step of automatically providing real-time game events information to the wagering module. The method may include the step of providing a wager option to a player in real-time that is selectable by a game-play action. The method may also include automatically calculating a modification in a wagering characteristic based in a hypothetical occurrence of a game-play action of a particular player and automatically generating a wagering option for that player based on the modification.

According to one embodiment of the invention, there is a system of providing wagering over a computerized system. The system may include a computerized multi-player game. The game may include an integral game mechanics module for providing a game-play session over a computerized network. The game mechanics module may be in real-time communication with the wagering module and therethrough the wagering module automatically receiving real-time game event information. The game mechanics module may provide a wagering option to a player in real-time that is selectable by a game-play action.

The game may include an integral wagering module in communication with the integral game mechanics module, having a storage device for storing wager characteristics. The integral wagering module may validate a wager upon occurrence of movement or spawning of a physics-based game object. The wagering module may automatically calculate a modification in a wagering characteristic based in a hypothetical occurrence of a game-play action of a particular player and automatically generating a wagering option for that player based on the modification.

The game may also include a plurality of physics-based game objects module in communication with the integral game mechanics module, wherein control of the plurality of physics game objects influence game-play. The game may include a wager characteristic module in communication with the integral game mechanics module for tracking game mechanics during the game-play session and altering a wagering characteristic in response to a pre-defined physics-based game event occurrence. The computerized multi-player game may not include a third party interface module.

The game may include a graphical user interface module that may display wager information on the same screen as game-play information during game-play.

The system may include a tax module in communication with the integral wagering module that automatically calculates taxation of the winnings from the game-play session. The tax module may automatically collect and pay a calculated taxation of winnings.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
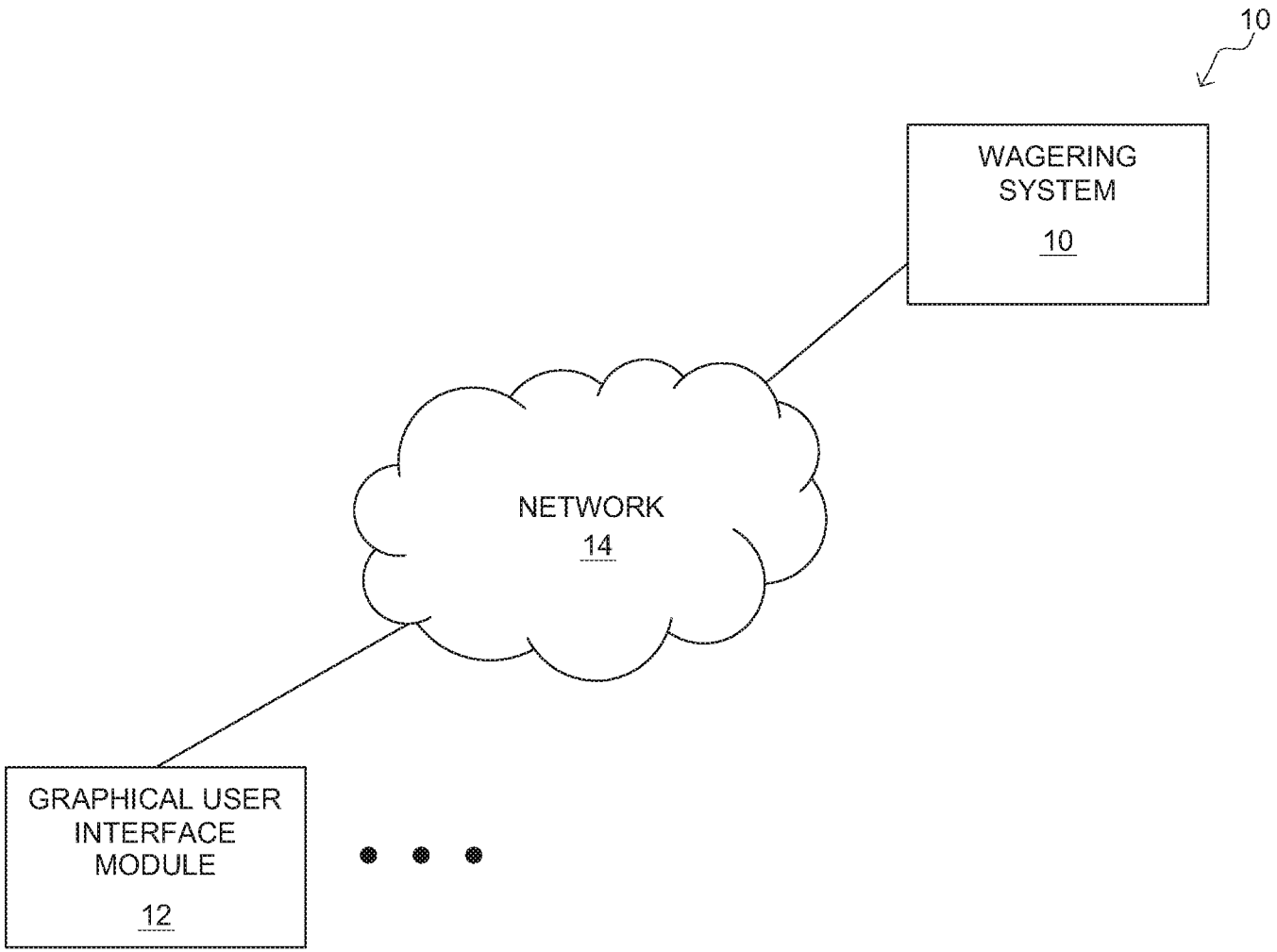
FIG. 1 is a network diagram of a system of providing wagering over a computerized network, according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Many of the functional units described in this specification have been labeled as modules in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like. Modules may also be implemented in software for execution by various types of processors. An identified module of programmable or executable code may, for instance, comprise one or more physical or logical blocks of computer instructions which may, for instance, be organized as an object, procedure, or function.

Nevertheless, the executables of an identified module need not be physically located together, but may comprise disparate instructions stored in different locations which, when joined logically together, comprise the module and achieve the stated purpose for the module. Indeed, a module and/or a program of executable code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network.

The various system components and/or modules discussed herein may include one or more of the following: a host server, motherboard, network, chipset or other computing system including a processor for processing digital data; a memory device coupled to a processor for storing digital data; an input digitizer coupled to a processor for inputting digital data; an application program stored in a memory device and accessible by a processor for directing processing of digital data by the processor, a display device coupled to a processor and/or a memory device for displaying information derived from digital data processed by the processor; and a plurality of databases including memory device(s) and/or hardware/software driven logical data storage structure(s).

Various databases/memory devices described herein may include records associated with one or more functions, purposes, intended beneficiaries, benefits and the like of one or more modules as described herein or as one of ordinary skill in the art would recognize as appropriate and/or like data useful in the operation of the present invention.

As those skilled in the art will appreciate, any computers discussed herein may include an operating system, such as but not limited to: Android, iOS, BSD, IBM z/OS, Windows Phone, Windows CE, Palm OS, Windows Vista, NT, 95/98/2000, OS X, OS2; QNX, UNIX; GNU/Linux; Solaris; MacOS; and etc., as well as various conventional support software and drivers typically associated with computers. The computers may be in a home, industrial or business environment with access to a network. In an exemplary embodiment, access is through the Internet through a commercially-available web-browser software package, including but not limited to Internet Explorer, Google Chrome, Firefox, Opera, and Safari.

The present invention may be described herein in terms of functional block components, functions, options, screen shots, user interactions, optional selections, various processing steps, features, user interfaces, and the like. Each of such described herein may be one or more modules in exemplary embodiments of the invention even if not expressly named herein as being a module. It should be appreciated that such functional blocks and etc. may be realized by any number of hardware and/or software components configured to perform the specified functions. For example, the present invention may employ various integrated circuit components, e.g., memory elements, processing elements, logic elements, scripts, look-up tables, and the like, which may carry out a variety of functions under the control of one or more microprocessors or other control devices. Similarly, the software elements of the present invention may be implemented with any programming or scripting language such as but not limited to Eiffel, Haskell, C, C++, Java, Python, COBOL, Ruby, assembler, Groovy, PERL, Ada, Visual Basic, SQL Stored Procedures, AJAX, Bean Shell, and extensible markup language (XML), with the various algorithms being implemented with any combination of data structures, objects, processes, routines or other programming elements. Further, it should be noted that the present invention may employ any number of conventional techniques for data transmission, signaling, data processing, network control, and the like. Still further, the invention may detect or prevent security issues with a client-side scripting language, such as JavaScript, VBScript or the like.

Additionally, many of the functional units and/or modules herein are described as being "in communication" with other functional units, third party devices/systems and/or modules. Being "in communication" refers to any manner and/or way in which functional units and/or modules, such as, but not limited to, computers, networks, mobile devices, program blocks, chips, scripts, drivers, instruction sets, databases and other types of hardware and/or software, may be in communication with each other. Some non-limiting examples include communicating, sending, and/or receiving data and metadata via: a wired network, a wireless network, shared access databases, circuitry, phone lines, internet backbones, transponders, network cards, busses, satellite signals, electric signals, electrical and magnetic fields and/or pulses, and/or so forth.

As used herein, the term "network" includes any electronic communications means which incorporates both hardware and software components of such. Communication among the parties in accordance with the present invention may be accomplished through any suitable communication channels, such as, for example, a telephone network, an extranet, an intranet, Internet, point of interaction device (point of sale device, personal digital assistant, cellular phone, kiosk, etc.), online communications, off-line communications, wireless communications, transponder communications, local area network (LAN), wide area network (WAN), networked or linked devices and/or the like. Moreover, although the invention may be implemented with TCP/IP communications protocols, the invention may also be implemented using other protocols, including but not limited to IPX, Appletalk, IP-6, NetBIOS, OSI or any number of existing or future protocols. If the network is in the nature of a public network, such as the Internet, it may be advantageous to presume the network to be insecure and open to eavesdroppers. Specific information related to the protocols, standards, and application software utilized in connection with the Internet is generally known to those skilled in the art and, as such, need not be detailed herein. See, for example, DILIP NAIK, INTERNET STANDARDS AND PROTOCOLS (1998); JAVA 2 COMPLETE, various authors, (Sybex 1999); DEBORAH RAY AND ERIC RAY, MASTERING HTML 4.0 (1997); and LOSHIN, TCP/IP CLEARLY EXPLAINED (1997), the contents of which are hereby incorporated by reference.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

FIG. 1 is a network diagram of a system of providing wagering over a computerized network, according to one embodiment of the invention. There is shown a system for providing wagering 10 in communication with a plurality of graphical user interface modules 12 over a computerized network 14. The illustrated system 10 connects a player(s) and/or spectator(s) 12 to a wagering system 10 over a network 14 so that they can participate, to one degree or another, in a computerized game having a wagering element.

The illustrated system of providing wagering 10 is in communication with a plurality of graphical user interface modules 12 over a computerized network 14. The graphical user interface modules 12 include devices and programming sufficient to communicate with the network, to display game information to the users and to receive input from the users. Generally, such may be in the form of a personal computer, dumb-terminal, gaming console, smartphone, tablet, or the like, but other embodiments are contemplated. Such will generally include a processor, a display device (e.g. monitor, tv, touchscreen), an audio device (e.g. speaker, microphone), memory, a bus, a user input device (e.g. controller, keyboard, mouse, touchscreen), and a communication device (e.g. a network card, wireless transponder), each in communication with one or more of the others as appropriate for the function thereof, generally over the bus. There may be a plurality and a variety of such graphical user interface modules in communication with the wagering system over the network, with some being for players and others being for spectators, administrators and the like and combinations thereof.

The wagering system 10 itself may be embodied in one or more servers connected to the network, including but not limited to a processor, a display device, memory, a bus, a user input device (e.g. controller, keyboard, mouse, touchscreen), and a communication device (e.g. a network card, wireless transponder), each in communication with one or more of the others as appropriate for the function thereof, generally over the bus, as well as programming instructions for carrying out a game including a wagering component thereto.

The system 10 may be configured to provide a computerized multi-player game. The game may be a game that is not traditionally associated with gambling. Traditional gambling games are based on controlled randomization of outcomes. For example, card games use a predefined set of cards, wherein each card has the same likelihood as the others of being drawn. As another non-limiting example, dice games and other mechanical based games (slot machines and pachinko) require that the mechanical components be constructed in a specific manner so that outcome are not weighed in favor of a particular outcome. Indeed, there are innovations related directly to testing and improving the quality of dice and other randomizing devices. Further, traditional gambling ventures into skill-based games such as sports and racing, but in doing so uses mechanisms (e.g. odds ratios) to compensate for perceived variations from controlled randomization. Further, such games often have very strict rules against players participating in gambling associated with their games.

Conversely, skill-based games are those where, according to the rules of such a game, the players skill level in performing particular actions have a major influence on the outcome of the game and the quality of those actions is critical to determining that outcome. Some skill-based games utilize physical or physics-based objects, such as but not limited to balls, pucks, shuttles, vehicles, guns, and/or players physical bodies themselves, wherein the accuracy, timing and/or capability of a player to influence the physical placement, motion, and/or orientation of such objects (they follow rules of physics or rules that emulate the physics of the real-world) is central to the rules of the game, including but not limited to being tied to scoring events.

In contrast, dice are physical objects which are used to determine the outcome of games, but are intended to be fully random (to the degree possible) and skill in rolling the dice, when it occurs, is generally against the rules and considered to be cheating. Some games use structures or rules to reduce the likelihood of players who may be able to skillfully roll dice, such as but not limited to dice cups, long rolling lanes with penalties for not reaching a particular distance threshold, rules requiring specific scattering characteristics during rolls (e.g. the dice must bounce off a nearby wall or barrier. However, in a game using dice where the players attempted (and wherein the rules and play structure supported this so that the attempts were meaningful), through skill in rolling, to roll particular numbers, that game may instead be a skill-based game, even though it used dice.

The system 10 is configured to provide a game-play session over a computerized network 14. Such is accomplished by a shared communication protocol between the system 10 and the interface modules 12. Generally the system will control and manage the game and the interface modules allow players, spectators and/or officiators to participate in appropriate ways (e.g. players control one or more aspects of a game, spectators may be able to view aspects of a game not readily visible to players, officiators may have access to tools for enhanced observation and/or rule enforcement).

The system 10 may be configured to provide real-time communication with a wagering module and therethrough the wagering module automatically receiving real-time game event information. This allows for wagering events to occur during a skill-based game. Such may be accomplished by providing a game-state feed to a wagering module, allowing a wagering module to observe communication between the system and interface modules, and/or feeding scoring and other similar key game data to the wagering module as such events occur. The wagering module may also include the capability to request specific data from the system, such as but not limited to by operation of a query. Such communications may be scripted, may be triggered by the occurrence of other events (e.g. in game events, user actions), or may be randomly generated/built from a set of possible communications.

The system 10 may, through a wagering module, also provide a wagering option to a player in real-time that is selectable by a game-play action. Such may be embodied by displaying information about an option within the game display interface and associated the selection of such an option with a particular action by the player. Such an action may be associated with particular manipulation of a physics-based game object (e.g. throwing a pass to a particular receiver instead of other available receivers, driving down one fork in a racetrack instead of another, shooting a target). Non-limiting examples of selectable wagering options may include, placing a wager, modifying payment on a wager or wager option, closing out an open wagering option, opening for selection a new wagering option, withdrawing a wager, and/or changing a wager or wager option characteristic (e.g. maximum/minimum wager amount, game event on which the wager is based, maximum/minimum number of wager participants allowed). Triggering a wager option in this manner may have a natural in-game effect (e.g. requiring that the selecting player continue down the particular fork selected which may be longer/shorter and/or more/less difficult than the other) and/or may have additional in-game consequences that are automatically associated therewith (e.g. the player automatically losing a life upon selection, spawning additional obstacles/enemies, reducing/increasing fuel in a vehicle driven by the player) and such additional consequences may be displayed in association with the display of the option.

The system 10 includes a storage device for storing wager characteristics. Such will generally take the form of one or more hard drives, solid-state drives, RAM modules, tapes, CDs, or other similar data storage devices.

The system 10 may validate a wager upon occurrence of movement or spawning of a physics-based game object, which may be associated with a start of a game session, an in-game event related to scoring, and/or an in-game event related to altering a characteristic/rule of a game. Wager validation may include one or more of the following: closing a wager against additional participants in the wager, verifying availability of funds to pay against a lost wager, removing invalid wagers from a set of placed wagers, and/or locking a wager or a wager option so that one or more (or all) of its characteristics may not be changed.

The system 10 may also automatically calculate a wagering option structure and/or a modification in a wagering characteristic based in a hypothetical occurrence of a game-play action of a particular player and automatically generating a wagering option for that player based on the modification. As a non-limiting example, a wagering module may query the system for records associated with a particular user, may analyze those records to determine a win/lose ratio associated with whether that particular user selected a particular choice in-game (e.g. a fork in a road for a racing game) and then may automatically calculate an appropriate wager characteristic modification for an ongoing wager that accounts for which path the player takes. The system may then automatically generate and present a wagering option, displayed on the play screen of that user, associated with the wager characteristic modification and allow the player to select from one or more such displayed wagering options, then implementing the associated consequences for that selection.

The system 10 also tracks game mechanics during the game-play session and altering a wagering characteristic in response to a pre-defined physics-based game event occurrence. Such may be accomplished by a wagering module having access to game state information and/or other play information (e.g. a feed, query) and applying the same against a pre-defined trigger rule, which, when triggered, automatically alters a record in data storage associated with a particular wager or wager option. As a non-limiting example, there may be an online soccer game with a particularly skilled player and the wagering module may keep track of who is playing on the field and if that particular skilled player is removed from the field (e.g. through fouls, network connectivity issues, pulled by the coach), the wagering module may automatically change payout odds in an open wager option.

The plurality of graphical user interface modules 14 may display wager information on the same screen as game-play information during game-play. There are some wagering systems that are associated with playing skill-based games that are not fully integrated into the game itself and thus the wagering information is either presented on a different page/view of the game than the game itself and/or may be viewed by activating a completely different executable through the user interface (or even through a different user interface). It may be that the wager information from the system may be displayed on the same screen as the game-play at the same time as the game-play and/or may be overlaid on the game-play display, thus being fully integrated into the game itself.

The system 10 may be configured to automatically calculate taxation of the winnings from the game-play session. In association with a wager payout, the system may calculate an appropriate tax for that payout associated with a particular authority (e.g. government, game administrator) according to whatever taxation rules may apply. The system may display the calculated amount and/or any remainder that would be after paying that amount. It may record the amount in a data record. It may transmit that amount to a third party over a network. It may automatically place a hold on winnings associated with the amount due until it has received confirmation that the amount owed is paid. The system 10 may also automatically collect and/or pay a calculated taxation of such winnings. The system may be functionally coupled to an electronic payment system, an online banking system, a credit tracking system, and/or an electronic system of a third party. The system may include a payment and/or payment receipt system for sending and/or receiving payments associated with users, spectators, officiators and/or third parties.

The illustrated graphical user interface modules in communication with the modules and components of the system as necessary and configured to provide navigational and interface capabilities to the game user of the system. The interface module may include a touch-screen or video game controller configured to navigate the modules of the game mechanics module, the wagering module, and the system. The interface module is configured to provide interactive controls for play through a game-play session of the system. An interface module may include a console game system (e.g. PS3, Xbox, Wii, etc.), a smartphone, a tablet, a desktop computer, a kiosk, and the like and combinations thereof. Non-limiting examples of an interface module may be a display/interface module as described in U.S. Pat. No. 6,272,562, issued to Scott et al.; a touch screen interface module as described in U.S. Pat. Nos. 5,884,202 and 6,094,609, issued to Arjomand, which are incorporated for their supporting teachings herein.

The illustrated graphical user interface module includes a user account module in communication with the modules and components of the system. The user account module is configured to provide management and administration capabilities to the game user of the system. The user account module is configured to manage a plurality of accounts and the characteristics and parameters associated therewith, wherein the user account module is configured to store personal and financial data relating to the game user. In addition, the user account module is configured to store and set parameters, characteristics, preferences, settings, etc. of the game client. Non-limiting examples of an user account module may be an account management module as described in U.S. Patent Publication No.: 2003/0014509; or a management module as described in U.S. Pat. No. 8,265,650, which are incorporated for their supporting teachings herein.

According to one embodiment of the invention, there is a system of providing wagering over a computerized network that allows a wager award or prize to be integrally associated with a game of skill without requiring external layers of programming or applications to overlay the game of skill itself. Further, the system permits automation of many of the functions associated with providing a wager award or prize within a game of skill. Accordingly, the illustrated system permits players playing on game-play sessions to interact with the system which manages one or more aspects of the game, including one or more aspects of any wagering processes occurring within a game-play session, and then allows for automated transactions to occur in automatic association with the completion of any of those wagering processes. Thus, wagering of many types and styles within games of skill may occur in a seamless and automatic manner, thereby allowing the players to play/compete/participate to a maximum degree without being disturbed/disrupted/annoyed by having to perform many steps of a wagering process that to the players may seem clerical, mundane, administrative, or otherwise "not fun."

The illustrated system is coupled to each of the graphical user interface modules and a payment system over a computerized network such that information/instruction may pass therebetween to accomplish the purposes and/or processes of each. The system includes instructions (in coordination with the game client) for allowing player(s) to play one or more games, generally games of skill, over a computerized network. The system may include one or more physical servers, each having a processor, memory storage devices, a bus, and the like functionally couple together to perform data processing and storage functions needed to operate one or more functions of a game. The system may store account information for users of the system and may include interface information for such accounts that allow those accounts to be associated with particular payment systems, games, achievements, groups, guilds, teams, and the like. The system may serve one or more social media functions as well and/or may be functionally coupled to one or more social media systems/modules. The system may control access to wagering processes and/or to particular games, players or groups of players. The system may also provide spectator access to games being played such that people may be able to view games being played and/or buy tickets to view future games.

The illustrated graphical user interface modules are functionally coupled to the system and includes scripting, data, media, and/or user interface modules (e.g. GUI, game console, personal computer, tablet, smartphone application, smartphone, etc.) that permit user(s) to interface with the system, to play games and wager. Often such a graphical user interface module is configured to permit the user to provide instructions to the game including but not limited to game-play instructions and selections regarding games to play (which game, options within the game, cosmetic selections, etc.) while also providing feedback regarding the gameplay itself (visual and audible game cues) that allow the player to understand what is happening in the game, thereby providing meaningful interaction. Sometimes graphical user interface modules also include modules that process elements of the game play so that such may be accomplished with lower latency when games are played over a network.

The illustrated system is configured to provide a wager award integrated into a video game with a game of skill over a computerized network, wherein the wager award or prize is incorporated/integrated into the video gameplay. The system provides a method of directly providing wagering capabilities into a video game without requiring an external shell or third party authentication/management system for the wagering.

According to one embodiment of the invention, the system includes no interaction between the wagering engine and the game/respawn/etc. engine. The engines may merely exist together in the same game. The wagering becomes valid or restarts, either when there is a respawn, accelerating of a vehicle, or passing a physics-based game object between two players. The wagering system includes tax software and autopaying of taxes online with the game.

According to one embodiment of the invention, there is a video game wagering system that is configured to be user friendly, quick, and easy to setup and use. The system is configured to promote use and promote payment of tax dollars on wagering. The system includes incentives for skill development. The system is also configured to automatically generate tax dollars, and automatically establish wagering compliance. The system is configured to increase the intensity of experience for players, in addition to providing dramatic events for spectators. The spectators may observe a pro game and may be charged to attend or view the video game or wagering event.

Figure 2:
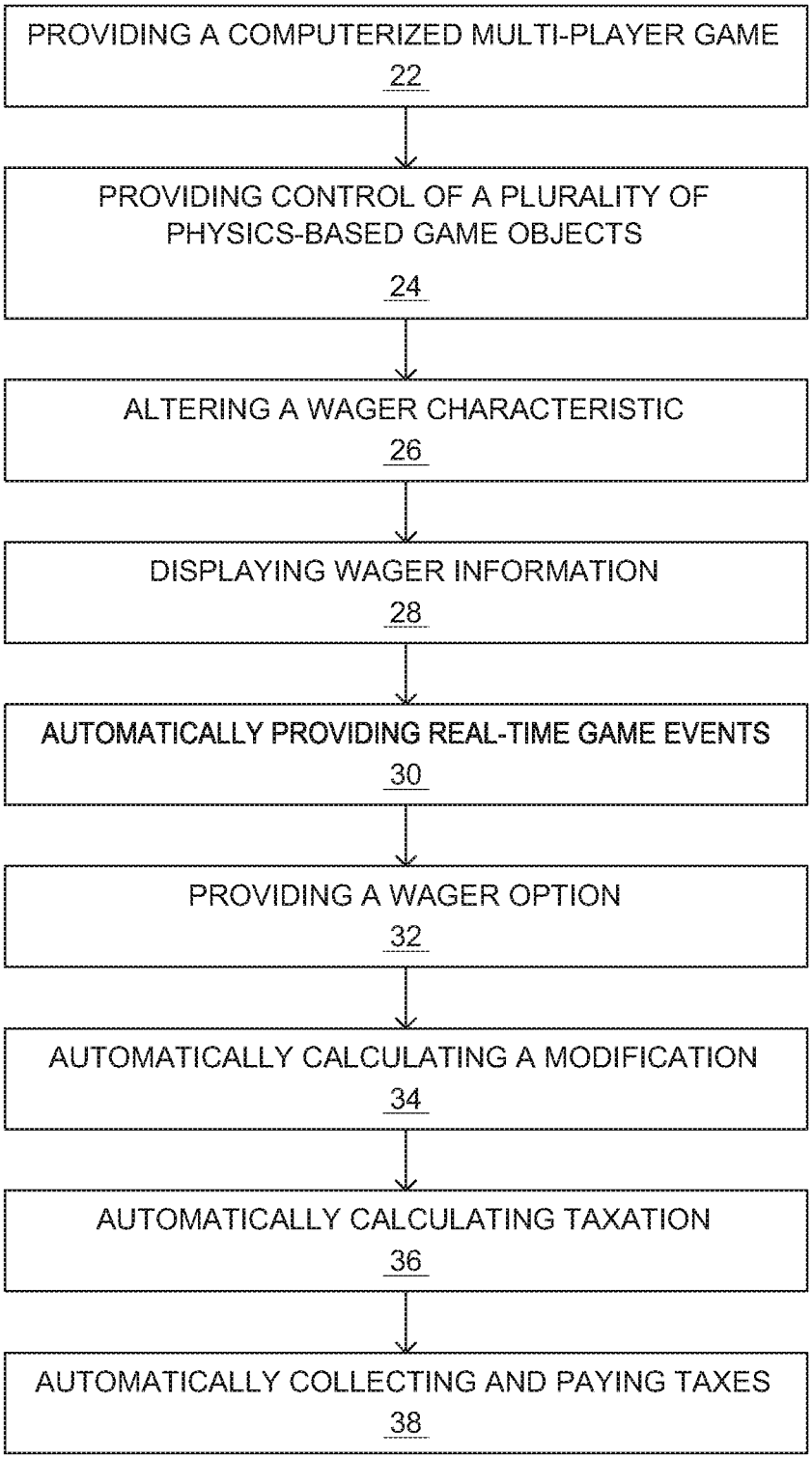
FIG. 2 is a flowchart of a method of providing wagering over a computerized network, according to one embodiment of the invention.

FIG. 2 is a flowchart of a method of providing wagering over a computerized network, according to one embodiment of the invention. There is shown a method of providing wagering over a computerized network 20.

The illustrated method of providing wagering 20 over a computerized network includes the step of providing, over a computerized network, a computerized multi-player game having an integral game mechanics module in communication with an integral wagering module having a data storage device for storing wager characteristics 22, such as but not limited to offering to users having electronic devices, over a network, connection to a multiplayer game having game-play and wagering features integral thereto.

The method 20 includes providing control of a plurality of physics-based game objects to players through the game mechanics module and during a game-play session, wherein control of the plurality of physics-based game objects influences game-play 24, such as but not limited to providing a skill-based game with game objects (e.g. players, balls, vehicles) that operate according to a physics engine that emulates one or more laws for physics (e.g. Newtonian mechanics).

The method 20 also includes the step of altering, by operation of a processor, a wager characteristic in response to occurrence of a predefined game mechanics event tracked by the game mechanics module during the game-play session 26, such as but not limited to changing an entry of a data record associated with a wager/wager option.

The altering step 26 may include the step of validating a wager, such as but not limited to: closing a wager against additional participants in the wager, verifying availability of funds to pay against a lost wager, removing invalid wagers from a set of placed wagers, and/or locking a wager or a wager option so that one or more (or all) of its characteristics may not be changed.

The method of providing wagering over a computerized network 20 includes displaying wager information on the same screen as game-play 28, such as but not limited to feeding display data over a network to a graphical user interface module of a user to overlay wager information over a game-play screen.

The method 20 includes the step of automatically providing real-time game event information to the wagering module 30, such as but not limited to feeding game-state data from a game mechanics module to a wagering module concurrently with generation of the same.

The method 20 includes providing a wager option to a player in real-time that is selectable by a game-play action 32, such as but not limited to displaying wager option information overlaid on a game-play screen during game-play in association with a game-selectable action for that user such that selection of that action triggers selection of the wagering option by that user.

The method 20 includes the step of automatically calculating a modification in a wagering characteristic based in a hypothetical occurrence of a game-play action of a particular player and automatically generating a wagering option for that player based on the modification 34, such as but not limited to by automatically postulating a plurality of selectable actions by a player, calculating an appropriate wager characteristic modification for one or more of such selectable actions based on historical game-play data for that user/team, and automatically generating and displaying a selectable wagering option for that player/team and effectuating the selection made once made.

The method of providing wagering over a computerized network 20 includes the step of automatically calculating taxation of a result of a wager session determined by the wagering module 36, such as but not limited to by querying a table of taxation rules on trigger of a payout event and applying an appropriate taxation rule from the query to an amount of the payout event.

The method 20 includes the step of automatically collecting and paying taxes from a user account within the multi-player game 38, such as but not limited to by debiting a payout account by an amount equal to a calculated tax owed, processing a payment to a third party to which the tax is owed, and/or automatically recording a confirmation of receipt of such payment in association with a record of the payout and/or the user for which the payout is intended.

According to one embodiment of the invention, there is a method of business for using different technologies to directly program the capability of placing wagers on respawn/vehicle/physics-based video games directly into the video games. The method of integrating wagering systems directly into respawn-based video games, including the capability of entering into a contest where money may be won directly from the game interface, not a third party interface or program or separate layer, it is directly into the body of the game itself and directly connects with the game operation. The wagering option may be on the same screen as the rest of the game. The wagering option may be available through the usual game interface. The operation of the game elements may be accessible to the wagering/contest system and there may be interaction therebetween. The game, the wagering system, the spectators and the participants may interact with respawn-based characteristics/events that may be associated with the game and the specific contest.

According to one embodiment of the invention, there is a method of business of programming the capability to place wagers on video games directly into skill based video games where there may be one or many types of technology. The wagering may be accompanied by or triggered by game events such as, but not limited to: respawning, acceleration of an automobile, or the passing of a ball. Wagering may be associated with game events, and not part of the game operation events, such as: the dealing of a card or the start of a deal, the start of a horse race or card game, or other traditional gambling events. The payment may be automatically taxed and the money sent to the federal government upon payout to a player. The system is configured to provide a video game where monetary prizes are available within the game.

According to one embodiment of the invention there is a system and/or method of integrating wagering processes directly into a game of skill, wherein the same executable functions, scripts, controls, and etc. that manage the game of skill also manage the wagering processes. Accordingly, the wagering processes have direct access to game information, scoring, achievements, commands, players, teams and the like and the players interact with the wagering processes using the same interface they use to play the game(s).

Figure 3:
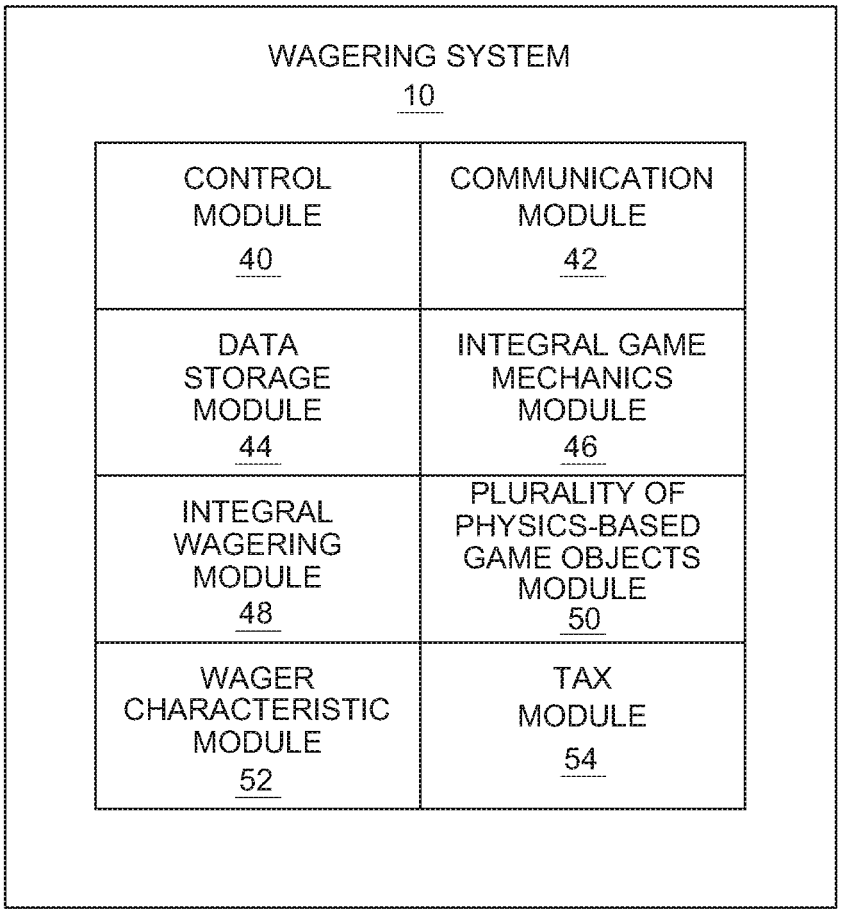
FIG. 3 is a module diagram of a system of providing wagering over a computerized network, according to one embodiment of the invention.

FIG. 3 is a module diagram of a system of providing wagering over a computerized network, according to one embodiment of the invention. There is shown a system for providing wagering 10 over a computerized network including a control module 30, a communication module 32, a data storage module 34, an integral game mechanics module 36, an integral wagering module 38, a plurality of physics-based game objects module 40, a wagering characteristics module 42, and a tax module 44.

The illustrated system of providing wagering over a computerized system 10 is configured to provide a computerized multi-player game. The illustrated system 10 includes a control module 30 that provides operational instructions and commands to the modules and components of the system 10. The control module 30 is in communication with the modules and components of the system 10 (and/or other modules described herein) and provides managerial instructions and commands thereto. The source of such instructions/commands may be from one or more other modules described herein and/or through interactions between one or more other modules described herein. The control module 30 sets parameters and settings for each module and component of the system 10. Non-limiting examples of a control module may be a control module described in U.S. Pat. No. 5,430,836, issued to Wolf et al.; or a control module described in U.S. Pat. No. 6,243,635, issued to Swan et al. which are incorporated for their supporting teachings herein. A control module may include but is not limited to a processor, a state machine, a script, a decision tree, and the like.

The illustrated system 10 includes a communication module 32, such as a network card, system bus, or wireless communication module, and communicates with a computerized network. The communication module 32 provides communication capabilities, such as wireless communication, to the modules and components of the system 10 and the components and other modules described herein. The communication module 32 provides communication between a wireless device, such as a mobile phone, and a computerized network and/or to facilitate communication between a mobile device and other modules described herein. The communication module 32 may have a component thereof that is resident on a user's mobile device. Non-limiting examples of a wireless communication module may be but not limited to: a communication module described in U.S. Pat. No. 5,307,463, issued to Hyatt et al.; or a communication module described in U.S. Pat. No. 6,133,886, issued to Fariello et al., which are incorporated for their supported herein.

The illustrated system 10 includes a data storage module 34 in communication with the modules and components of the system 10. The data storage module 34 collects and store data for each of the modules of the system 10. The data storage module 34 is in communication with the various modules and components of the system 10 over a computerized network and stores data transferred there through. The data storage module 34 stores data transferred through each of the modules of the system 10, thereby updating the system 10 with up to date data and real time game, wager, and user data. The data storage module 34 securely stores user data along with data transferred through the system 10. Data storage modules 34 may be databases and/or data files and the memory storage device may be, but is not limited to, hard drives, flash memory, optical discs, RAM, ROM, and/or tapes. A non-limiting example of a data base is Filemaker Pro 11, manufactured by Filemaker Inc., 5261 Patrick Henry Dr., Santa Clara, Calif., 95054. Non-limiting examples of a data storage module may include: a HP Storage Works P2000 G3 Modular Smart Array System, manufactured by Hewlett-Packard Company, 3000 Hanover Street, Palo Alto, Calif., 94304, USA; or a Sony Pocket Bit USB Flash Drive, manufactured by Sony Corporation of America, 550 Madison Avenue, New York, N.Y., 10022.

The illustrated system 10 includes an integral game mechanics module 36 for providing a game-play session over a computerized network. The game mechanics module 36 is in real-time communication with an integral wagering module 38 and therethrough the integral wagering module 38 automatically receives real-time game event information. The game mechanics module 36 provides a wagering option to a player in real-time that is selectable by a game-play action. Non-limiting examples of an game mechanics module may be a game system as described in U.S. Patent Publication No.: 2008/0096662; or a game module as described in WO2002062436, which are incorporated for their supporting teachings herein.

Such a game mechanics module may include a game engine, such as but not limited to the game engine sold under the name Source by Valve of Washington, Big World Technology by Big World of Australia, Hero Engine by Simutronics Corporation of www.simutronics.com, and the like. Non-limiting examples of a gameplay module may be a game system as described in U.S. Patent Publication No.: 2008/0096662; or a game module as described in WO2002062436, which are incorporated for their supporting teachings herein.

The illustrated system 10 includes an integral wagering module 38 in communication with the integral game mechanics module 36, having a storage device for storing wager characteristics. The integral wagering module 38 is configured to validate a wager upon occurrence of movement or spawning of a physics-based game object. The integral wagering module 38 automatically calculates a modification in a wagering characteristic based in a hypothetical occurrence of a game-play action of a particular player and automatically generating a wagering option for that player based on the modification. Non-limiting examples of a wagering module may be a gaming/gambling module as described in U.S. Patent Publication No.: 2011/0202269, by Reventlow; or a betting module as described in U.S. Patent Publication No.: 2011/0151963, by Doctor et al., which are incorporated for their supporting teachings herein.

The illustrated system 10 includes a plurality of physics-based game objects module 40 in communication with the integral game mechanics module 36, wherein control of the plurality of physics game objects influence game-play. The system 10 includes a wager characteristic module 42 in communication with the integral game mechanics module 36 for tracking game mechanics during the game-play session and altering a wagering characteristic in response to a pre-defined physics-based game event occurrence. Non-limiting examples of a game objects module may be a system as described in U.S. Pat. No. 8,346,889; or an apparatus as described in U.S. Patent Publication No.: 2009/0036216, which are incorporated for their supporting teachings herein.

The illustrated system 10 includes a tax module 44 in communication with the integral wagering module 38 that automatically calculates taxation of the winnings from the game-play session. The tax module 44 automatically collects and pays a calculated taxation of winnings. Non-limiting examples of a tax module may be a system as described in U.S. Patent Publication No.: 2005/0043998; or a system as described in WO2003044702, which are incorporated for their supporting teachings herein.

Figure 4:
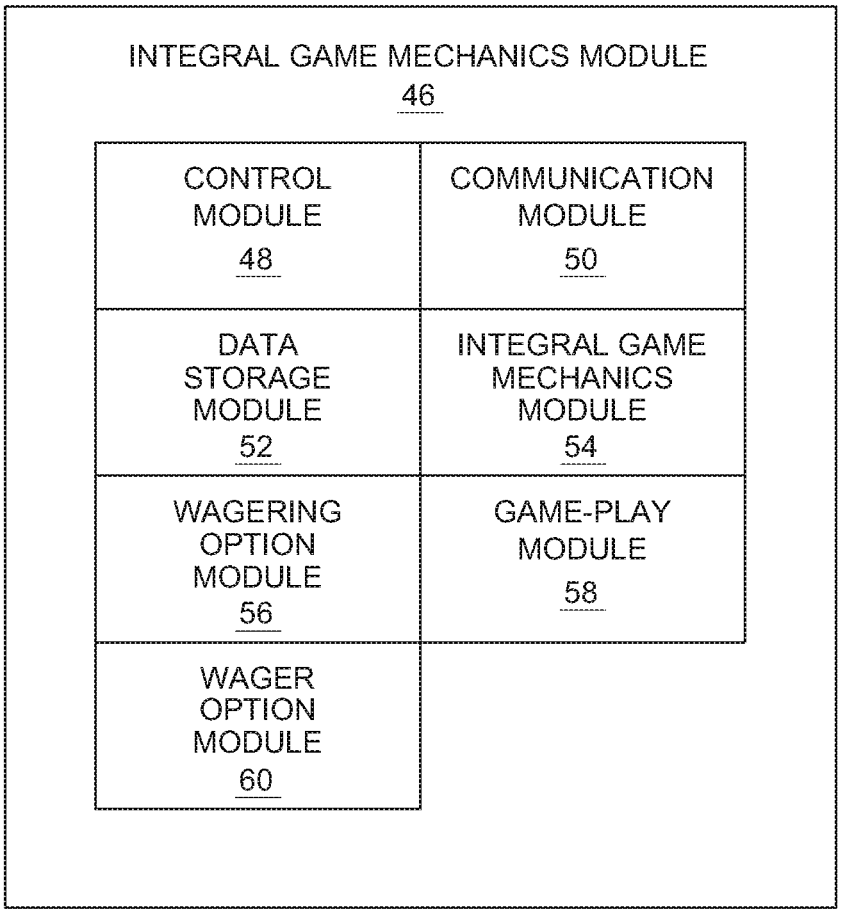
FIG. 4 is a module diagram of an integral game mechanics module, according to one embodiment of the invention.

FIG. 4 is a module diagram of an integral game mechanics module, according to one embodiment of the invention. There is shown an integral game mechanics module 36 including a control module 46, a communication module 48, a data storage module 50, a game-play module 52, and a wagering option module 54.

The illustrated integral game mechanics module 36 is configured to provide a game-play session over a computerized network. The game mechanics module 36 is in real-time communication with the integral wagering module and therethrough the integral wagering module automatically receives real-time game event information. The integral game mechanics module 36 is configured to provide a wagering option to a player in real-time that is selectable by a game-play action. Non-limiting examples of a gameplay module may be a game system as described in U.S. Patent Publication No.: 2008/0096662; or a game module as described in WO2002062436, which are incorporated for their supporting teachings herein.

The illustrated integral game mechanics module 36 includes a control module 46 that provides operational instructions and commands to the modules and components of the integral game mechanics module 36. The control module 46 is in communication with the modules and components of the system and integral game mechanics module 36 (and/or other modules described herein) and provides managerial instructions and commands thereto. The source of such instructions/commands may be from one or more other modules described herein and/or through interactions between one or more other modules described herein. The control module 46 sets parameters and settings for each module and component of the integral game mechanics module 36.

The illustrated integral game mechanics module 36 includes a communication module 48, such as a network card, system bus, or wireless communication module, and communicates with a computerized network. The communication module 48 provides communication capabilities, such as wireless communication, to the modules and components of the integral game mechanics module 36 and the components and other modules described herein. The communication module 48 provides communication between a wireless device, such as a mobile phone, and a computerized network and/or to facilitate communication between a mobile device and other modules described herein. The communication module 48 may have a component thereof that is resident on a user's mobile device.

The illustrated integral game mechanics module 36 includes a data storage module 50 in communication with the modules and components of the integral game mechanics module 36. The data storage module collects and store data for each of the modules of the integral game mechanics module 36. The data storage module is in communication with the various modules and components of the system and the integral game mechanics module 36 over a computerized network and stores data transferred there through. The data storage module stores data transferred through each of the modules of the system and the integral game mechanics module 36, thereby updating the system and integral game mechanics module 36 with up to date data and real time game, wager, and user data. The data storage module securely stores user data along with data transferred through the system and the integral game mechanics module 36.

The illustrated integral game mechanics module 36 includes a game-play module 52 in communication with the modules and components of the integral game mechanics module 36. The game-play module 52 is configured to provide a game-play session over a computerized network. The game-play module 52 is configured to provide operational controls for interacting and interfacing a game-play session over a computerized network. The game-play module 52 is configured to provide real-time game mechanics and game information to a plurality of graphical user interface modules over a computerized network.

The illustrated integral game mechanics module 36 includes a wagering option module 54 in communication with the modules and components of the integral game mechanics module 36. The wagering option module 54 is configured to provide a wagering option to a player in real-time that is selectable by a game-play action.

Figure 5:
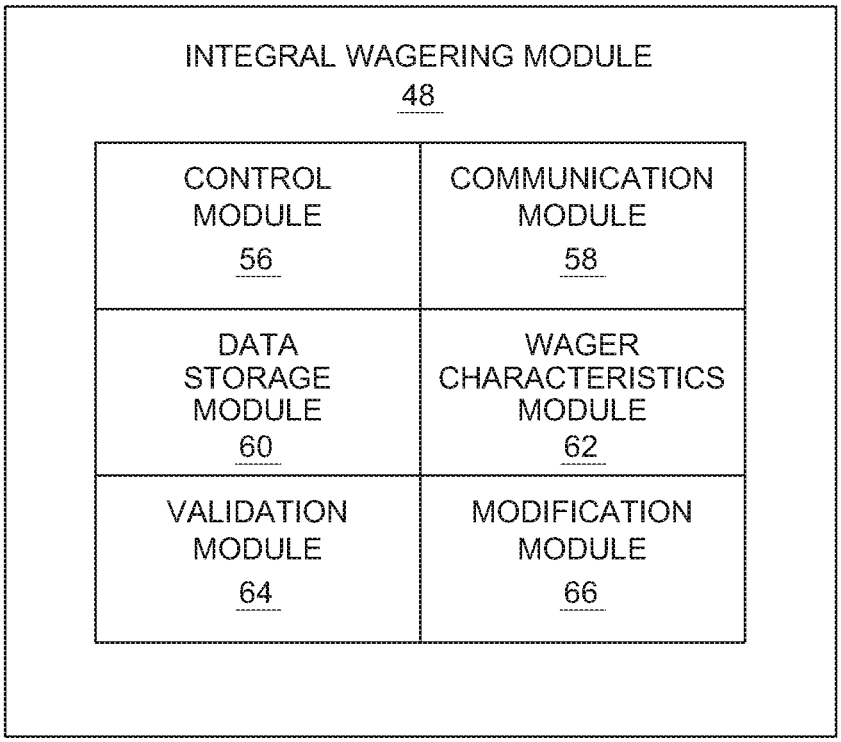
FIG. 5 is a module diagram of an integral wagering module, according to one embodiment of the invention.

FIG. 5 is a module diagram of an integral wagering module, according to one embodiment of the invention. There is shown an integral wagering module 38 including a control module 56, a communication module 58, a data storage module 60, a validation module 62, and a modification module 64.

The illustrated integral wagering module 38 is in communication with the integral game mechanics module, and is configured to store wager characteristics. The integral wagering module 38 validates a wager upon occurrence of movement or spawning of a physics-based game object. The integral wagering module 38 automatically calculates a modification in a wagering characteristic based in a hypothetical occurrence of a game-play action of a particular player and automatically generating a wagering option for that player based on the modification.

The illustrated integral wagering module 38 includes a control module 56 that provides operational instructions and commands to the modules and components of the integral wagering module 38. The control module 56 is in communication with the modules and components of the system and the integral wagering module 38 (and/or other modules described herein) and provides managerial instructions and commands thereto. The source of such instructions/commands may be from one or more other modules described herein and/or through interactions between one or more other modules described herein. The control module 56 sets parameters and settings for each module and component of the integral wagering module 38.

The illustrated integral wagering module 38 includes a communication module 58, such as a network card, system bus, or wireless communication module, and communicates with a computerized network. The communication module 58 provides communication capabilities, such as wireless communication, to the modules and components of the system and the components and other modules described herein. The communication module 58 provides communication between a wireless device, such as a mobile phone, and a computerized network and/or to facilitate communication between a mobile device and other modules described herein.

The illustrated integral wagering module includes a data storage module 60 or a storage device in communication with the modules and components of the integral wagering module 38. The data storage module 60 collects and store data for each of the modules of the integral wagering module 38. The data storage module 60 is in communication with the various modules and components of the system over a computerized network and stores data transferred there through. The data storage module 60 stores data transferred through each of the modules of the integral wagering module 38, thereby updating the system and the integral wagering module 38 with up to date data and real time game, wagering, and user data. The data storage module 60 securely stores user data along with data transferred through the integral wagering module 38.

The illustrated integral wagering module 38 includes a validation module 62 configured to validate users and a wager on an outcome of a game-play session. The validation module 62 confirms the wager and the players before the start of the game-play session. Non-limiting examples of a validation module may be a verification module as described in U.S. Pat. No. 7,610,107, issued to Scharnick et al.; or a verification module as described in U.S. Pat. No. 7,194,632, issued to Guerin et al., which are incorporated for their supporting teachings herein.

The illustrated integral wagering module 38 includes a modification module 64 configured to modify a wager during a game-play session, either to decrease or increase the possible payout, at the end of the game-play session, based upon varying degrees of obstacles or opponents during game-play. Non-limiting examples of a modification module may be a system as described in U.S. Patent Publication 2013/0130659; or a system as described in U.S. Patent Publication No.: 20100048293, which are incorporated for their supporting teachings herein. The illustrated system 10 does not include a third party interface module.

Figure 6:
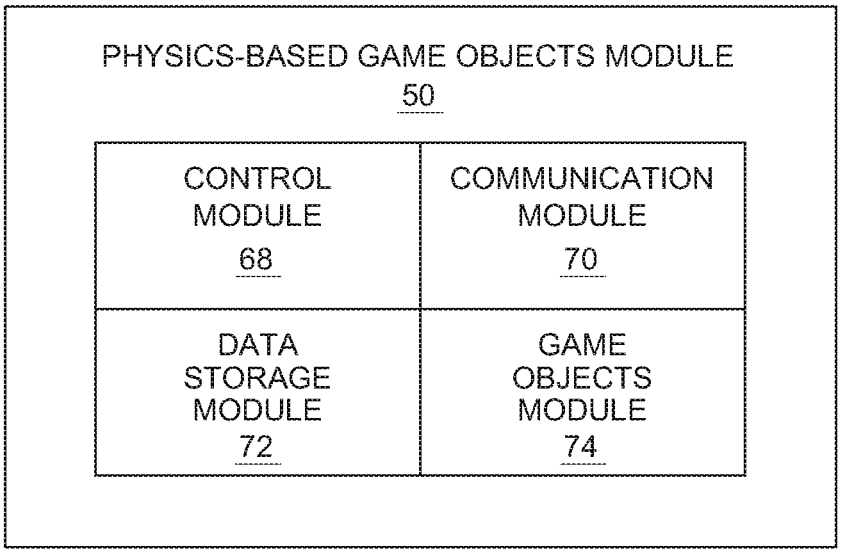
FIG. 6 is a module diagram of a physics-based game objects module, according to one embodiment of the invention.

FIG. 6 is a module diagram of a physics-based game objects module, according to one embodiment of the invention. The physics-based game objects module 40 includes a control module 66, a communication module 68, a data storage module 70, and a game objects module 72.

The illustrated plurality of physics-based game objects module 40 is in communication with the integral game mechanics module, wherein control of the plurality of physics game objects influence game-play.

The illustrated plurality of physics-based game objects module 40 includes a control module 66 that provides operational instructions and commands to the modules and components of the plurality of physics-based game objects module 40. The control module 66 is in communication with the modules and components of the system and the plurality of physics-based game objects module 40 (and/or other modules described herein) and provides managerial instructions and commands thereto. The source of such instructions/commands may be from one or more other modules described herein and/or through interactions between one or more other modules described herein. The control module 66 sets parameters and settings for each module and component of the plurality of physics-based game objects module 40.

The illustrated plurality of physics-based game objects module 40 includes a communication module 68, such as a network card, system bus, or wireless communication module, and communicates with a computerized network. The communication module 68 provides communication capabilities, such as wireless communication, to the modules and components of the system and the components and other modules described herein. The communication module 68 provides communication between a wireless device, such as a mobile phone, and a computerized network and/or to facilitate communication between a mobile device and other modules described herein.

The illustrated plurality of physics-based game objects module 40 includes a data storage module 70 in communication with the modules and components of the plurality of physics-based game objects module 40. The data storage module 70 collects and store data for each of the modules of the plurality of physics-based game objects module 40. The data storage module 70 is in communication with the various modules and components of the system over a computerized network and stores data transferred there through. The data storage module 70 stores data transferred through each of the modules of the plurality of physics-based game objects module 40, thereby updating the system and the plurality of physics-based game objects module 40 with up to date data and real time game, wagering, and user data. The data storage module 70 securely stores user data along with data transferred through the plurality of physics-based game objects module 40.

The illustrated physics-based game objects module 40 includes a game objects module 72 configured to identify, create, provide, alter or otherwise manage various events or game objects or game modes during game-play interaction. Such events or objects may be triggers that trigger the modification module. Such may include spawning/respawning, scoring, player addition/removal and the like and combinations thereof. Such a game objects module may be subsumed during game-play or otherwise subordinate thereto, or it may be related in other ways (such as but not limited to being superior in functional priority) to the game mechanics module in order to allow functionality such as but not limited to restricting or delaying normal game operation until wagering events occur. Further, the game objects module may manage wagering sessions, gaming sessions and the like and may manage a plurality of players and/or spectators in interacting with such a session. The plurality of graphical user interface modules may select from various events of game-play to be wagered through the game mechanics module. The game objects module is configured to provide a plurality of options or scenarios for users, that are playing or observing the game-play to wager on.

Figure 7:
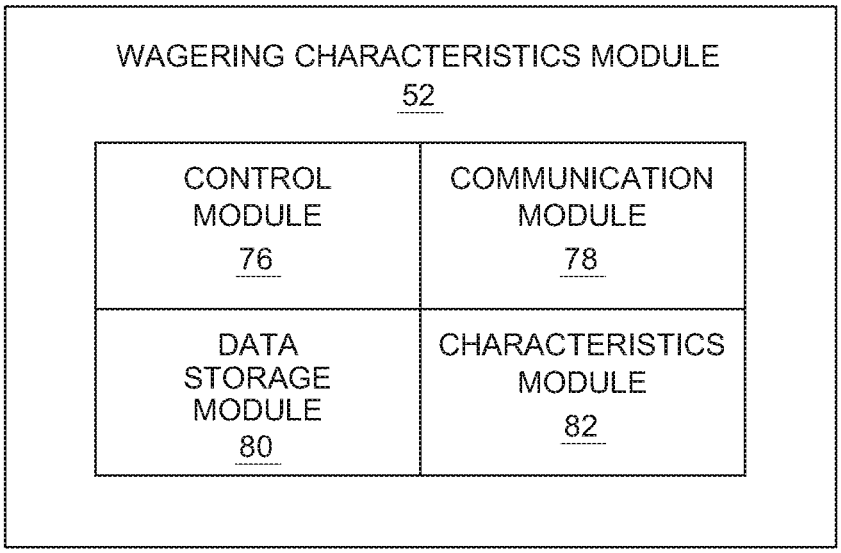
FIG. 7 is a module diagram of a wagering characteristics module, according to one embodiment of the invention.

FIG. 7 is a module diagram of a wagering characteristics module, according to one embodiment of the invention. There is shown a wagering characteristics module 42 including a control module 74, a communication module 76, a data storage module 78, and a wagering characteristics module 80.

The illustrated wager characteristic module 43 is in communication with the integral game mechanics module for tracking game mechanics during the game-play session and altering a wagering characteristic in response to a predefined physics-based game event occurrence.

The illustrated wagering characteristics module 42 includes a control module 74 that provides operational instructions and commands to the modules and components of the wagering characteristics module 42. The control module 74 is in communication with the modules and components of the system and the wagering characteristics module 42 (and/or other modules described herein) and provides managerial instructions and commands thereto. The source of such instructions/commands may be from one or more other modules described herein and/or through interactions between one or more other modules described herein. The control module 74 sets parameters and settings for each module and component of the wagering characteristics module 42.

The illustrated wagering characteristics module 42 includes a communication module 76, such as a network card, system bus, or wireless communication module, and communicates with a computerized network. The communication module 76 provides communication capabilities, such as wireless communication, to the modules and components of the system and the components and other modules described herein. The communication module 76 provides communication between a wireless device, such as a mobile phone, and a computerized network and/or to facilitate communication between a mobile device and other modules described herein.

The illustrated wagering characteristics module 42 includes a data storage module 78 in communication with the modules and components of the wagering characteristics module 42. The data storage module 78 collects and store data for each of the modules of the wagering characteristics module 42. The data storage module 78 is in communication with the various modules and components of the system over a computerized network and stores data transferred there through. The data storage module 78 stores data transferred through each of the modules of the wagering characteristics module 42, thereby updating the system and the wagering characteristics module 42 with up to date data and real time game, wagering, and user data. The data storage module 78 securely stores user data along with data transferred through the wagering characteristics module 42.

The illustrated wagering characteristics module 42 includes a characteristics module 80 configured to provide wagering characteristics to users of the system before and during a game-play session. The wagering characteristics module 42 provides various wagering characteristics to a user of the system, before and during game-play. The characteristics may define the settings and parameters for various wagers during a game-play session.

Figure 8:
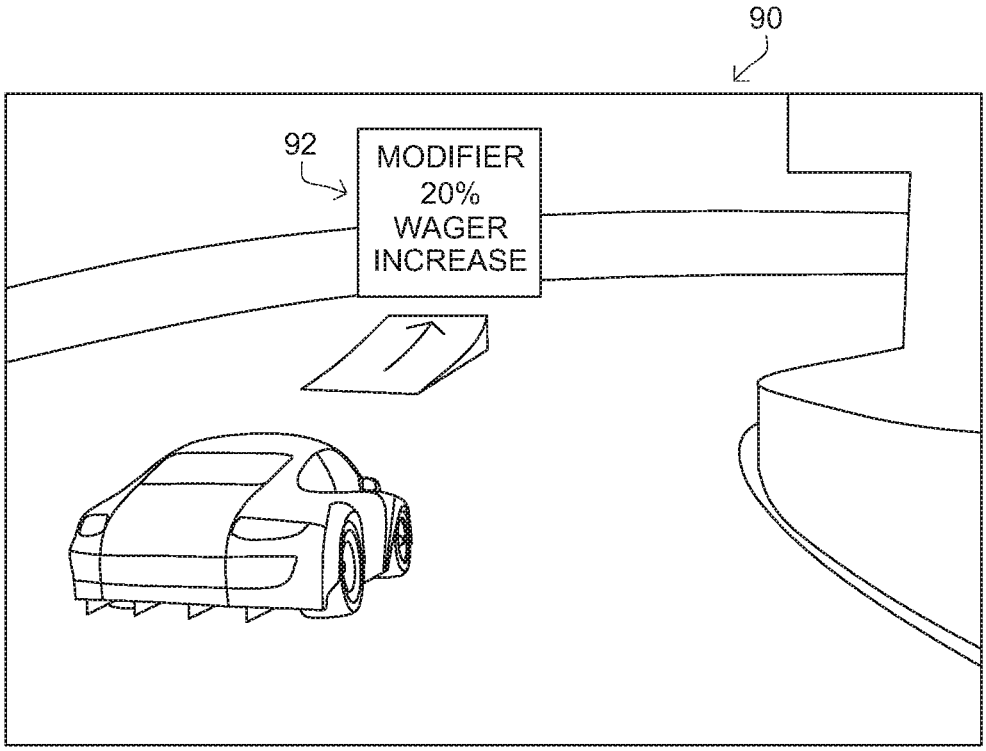
FIG. 8 is a prophetic screenshot of a video game-play session including a modification option, according to one embodiment of the invention.

FIG. 8 is a prophetic screenshot of a video game-play session including a modification option, according to one embodiment of the invention. There is shown a game-play session 90 including a modification option 92 during real-time game-play.

The illustrated game-play session 90 is a race car game, wherein a user navigates a car through a course or track and gathers points during game-play based on time and route taken. The game-play session 90 includes a modification option 92 during game-play that allows the user to increase the wager odds based upon the increase of difficulty of the modification option 92. The modification option 92 may vary depending on the game, game-play, wager, and the user.

According to one embodiment of the invention there is a game client, such as but not limited to the Steam game client by Valve Corporation of Washington, the Wii Fit game client by Nintendo Corporation of Washington, the Games for Windows—LIVE game client by Microsoft of Washington, and the like and combinations thereof, wherein the game client is capable of allowing players to play a plurality of games of skill and wagering processes are built directly into the game client and/or directly into the game executable of each of the games so enabled.

According to one embodiment of the invention there is a system/method of wagering wherein electronic games of skill include a single game interface having both wagering process interactivity and game interactivity. Spectators may be charged a fee to observe a game being played.

According to one embodiment of the invention there is a system/method of wagering in an electronic game wherein a wagering process includes a trigger that is triggered by a player spawning (or respawning). Spawning/respawning is generally when a game object controlled by a player forms, resets or partially resets, usually in response to a game session beginning or a failure/success event (player dying or losing a life, race car falling off the track, completing a level, scoring a goal, etc.). Wagering processes may include one or more of the following: opening a wagering session, closing a wagering session, restricting wagering interaction options, permitting a wagering interaction option, determining a minimum/maximum payout/odds for a wager, allowing a spectator to wager, restricting a spectator from wagering, paying out a wager, assigning ownership of a wager award, initiating/concluding a wager interaction, initiating/concluding a wager interaction opportunity, opening/closing a wagering interface, verifying a wager, validating a wager, finalizing a wager/wager amount, displaying a wager or wager information to others, incrementing/decrementing a wager/odd/payout amount, requiring an ante to be payed, beginning a count-down timer for a wagering process to occur, and the like and combinations thereof. Additionally, the system/process may include a spawning/respawning event that is triggered by or otherwise contingent on a wagering process occurring. As a non-limiting example, a user may be required to dedicate an additional ante for each time they respawn before the respawn and/or respawn timer can occur, or such a payment may skip a respawn timer and allow the player to immediately respawn. Additionally, such trigger(s) may include one or more of the following: acceleration of a vehicle, a game object traversing a particular point/plane, a scoring action by a player, receipt of a game object by a player (one player catching a ball object thrown by another player), a game object colliding with another game object, a player being removed from play (e.g. dodge ball player going "out"), and the like and combinations thereof.

According to one embodiment of the invention there is a wager award system/process wherein a wagering process interface is integrated directly into a game system of a game of skill such that players of a game of skill may selectably wager using automated tools built directly into the system over games played within such a system without having to access external systems/tools/software/etc. in order to place an be awarded a wager.

According to one embodiment of the invention there is a wager award system/method that includes a tax module that automatically calculates and/or automatically pays a tax on a wager award assigned to a player. The system may also automatically generate a report for the player to use in preparing/filing their own taxes. The system may also automatically cause/instruct a payment system to pay a calculated or otherwise predetermined amount of taxes or other payment to a payment recipient.

Advantageously, such a system/method, as those described herein, may create a user friendly experience that is quick, easy, fun, that promotes more/further use of the system, that generates and automatically pays taxes/fees to relevant authorities, incentivizes skill development, automatically provides for compliance with authorities, increases the intensity and/or enjoyment of games of skill and/or provides a more dramatic experience for spectators.

Non-Limiting Prophetic Example 1

A set of players begins a first person shooter game and are each allowed to place a tentative wager on the game. Upon the (n)th kill in the game session, a countdown timer is activated and visible on the user interface. Once the countdown timer reaches zero, all active wagers are set as final and unchangeable until the game session ends.

Non-Limiting Prophetic Example 2

A player begins a car racing game and places a wager amount within the interface (same interface as the race and car selection) that provides for a payout schedule to the player if the player places in the top three places within the game. The player plays the game and based on performance in the game session either receives a payout or does not.

Non-Limiting Prophetic Example 3

Two teams of players use the system to create a game session for a real-time third person strategy game. The system announces the game to a pool of prospective spectators and sells tickets to the game. Proceeds from the tickets are allocated as prize money for the game sessions. The teams play the game in view of the spectators. One team wins and their prize money is split between the various members. Fees and taxes for each member are automatically calculated and deducted from the prize amount. The players receive their winnings, minus taxes and fees. The taxes and fees are reported to the appropriate authorities and paid, with tax ready reports sent electronically to each of the winning players.

Non-Limiting Prophetic Example 4

A group of players play a game wherein a scoring/failure event results in a player being eliminated a pause in game play and a new round of game play being started after a countdown timer until there is only one player left remaining. Each player pays an ante to play. The total ante is recognized as the prize for the winner. During the countdown timer, all remaining players may place wagers associated with game events they believe are likely to occur. The system automatically calculates odds of such events occurring and automatically gives payout odds and/or matches specific wagers among players that are for/against such an event occurring. Wager payout amounts are automatically restricted to be less than a predefined percentage of the total prize for the winner divided by the number of remaining players and wagers by players against themselves are not allowed by the system. Once the countdown finishes, wagering is restricted and wagers are final. Payouts and losses are accumulated by players among the rounds and winnings from previous rounds may be used as wagers in subsequent rounds.

Non-Limiting Prophetic Example 5

A guild of players of a MMORPG prepare to collectively confront a boss-style encounter within the MMORPG environment. On entering the "lair" of the encounter, a wagering session is triggered and in the same interface as the game a pop-up question appears wherein each player is enabled to wager a specific amount of their virtual currency within the MMORPG on successfully defeating the encounter. A record is kept regarding the total amount wagered by the members of the guild and a treasure drop schedule is utilized to determine what treasure may be randomly generated based on the accumulated amounts bet by the guild and/or other factors such as but not limited to how many times the guild or individuals within the guild have overcome the encounter and etc. If the guild defeats the encounter, then each individual receives a payout based on the amount they wagered, and the guild receives the treasure from the encounter. If the guild fails to defeat the encounter, the amounts wagered are lost. If the encounter has yet to be defeated, a portion of the amount bet by the guild may accumulate as part of a bonus payout for the first guild to beat the encounter.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. A method of providing wagering over a computerized network, comprising the steps of:

a) providing, over a computerized network, a computerized multi-player competitive skill-based game having an integral game mechanics module in real-time communication with an integral wagering module such that the integral wagering module receives real-time game event information from the integral game mechanics module, the integral wagering module;

b) providing control of a plurality of physics-based game objects to players through the game mechanics module and during a game-play session, wherein control of the plurality of physics-based game objects influences competitive game-play; and c) automatically executing, on trigger of the integral wagering module receiving a specific predefined real-time game event information from the integral game mechanics module, a wagering process associated with a player of the competitive skill-based game.

2. The method of claim 1, further comprising the step of automatically calculating taxation of a result of a wager session determined by the wagering module.

3. The method of claim 2, further comprising the step of automatically collecting and paying taxes from a user account within the multiplayer game.

4. The method of claim 1, wherein the wagering process of the step of automatically executing is selected from the group of wagering processes consisting of: opening a wagering session, closing a waging session, restricting wagering interaction options, permitting a wagering interaction option, determining a minimum/maximum payout/odds for a wager, allowing a spectator to wager, restricting a spectator from wagering, paying out a wager, assigning ownership of a wager award, initiating/concluding a wager interaction, initiating/concluding a wager interaction opportunity, opening/closing a wagering interface, verifying a wager, validating a wager, finalizing a wager/wager amount, displaying a wager or wager information to others, incrementing/decrementing a wager/odd/payout amount, requiring an ante to be payed, beginning a count-down timer for a wagering process to occur.

5. The method of claim 1, further comprising the step of displaying wager information on the same screen as game-play.

6. The method of claim 1, further comprising the step of providing a wager option to a player in real-time that is selectable by a game-play action.

7. The method of claim 6, further comprising the step of automatically calculating a modification in a wagering characteristic based in a hypothetical occurrence of a game-play action of a particular player and automatically generating a wagering option for that player based on the modification.

8. A system of providing wagering over a computerized system, comprising:

a) a computerized skill-based multi-player game including:

a1) an integral game mechanics module for providing a game-play session over a computerized network, wherein the integral game mechanics module generates game event information;

a2) an integral wagering module in real-time communication with the integral game mechanics module, such that the integral wagering module receives real-time game event information;

a3) a plurality of physics-based game objects module in communication with the integral game mechanics module, wherein control of the plurality of physics game objects influence game-play;

a4) a wager characteristic module in communication with the integral game mechanics module for tracking game mechanics module during the game-play session and executing a wagering process in response to a pre-defined physics-based game event occurrence automatically identified and triggered by receipt of associated game event information.

9. The system of claim 8, wherein the computerized multi-player game does not include a third party interface module.

10. The system of claim 8, further comprising a tax module in communication with the integral wagering module that automatically calculates taxation of the winnings from the game-play session.

11. The system of claim 10, wherein the tax module automatically collects and pays a calculated taxation of winnings.

12. The system of claim 8, wherein the integral wagering module validates a wager upon occurrence of movement or spawning of a physics-based game object.

13. The system of claim 8, wherein the computerized multi-player game includes a graphical user interface module that displays wager information on the same screen as game-play information during game-play.

14. The system of claim 8, wherein the game mechanics provides a wagering option to a player in real-time that is selectable by a game-play action.

15. The system of claim 14, wherein the wagering module automatically calculates a modification in a wagering characteristic based in a hypothetical occurrence of a game-play action of a particular player and automatically generating a wagering option for that player based on the modification.

16. A system of providing wagering over a computerized system, comprising:

a) a computerized multi-player skill-based competitive game including:

a1) an integral game mechanics module for providing a real-time game-play session over a computerized network;

a2) an integral wagering module in communication with the integral game mechanics module, wherein the integral wagering module receives real-time game event information from the integral game mechanics module and automatically executes a wagering process in response to received game event information; and a3) a plurality of physics-based game objects module in communication with the integral game mechanics module, wherein control of the plurality of physics game objects influence game-play and generates, directly or indirectly, game event information.

17. The system of claim 16, further including a wager characteristic module in communication with the integral game mechanics module for tracking game mechanics module during the game-play session and altering a wagering characteristic in response to a pre-defined physics-based game event occurrence.

18. The system of claim 16, wherein the computerized multi-player game includes a graphical user interface module that displays wager information on the same screen as game-play information during game-play.

19. The system of claim 7, wherein the game mechanics provides a wagering option to a player in real-time that is selectable by a game-play action.

20. The system of claim 19, wherein the wagering module automatically calculates a modification in a wagering characteristic based in a hypothetical occurrence of a game-play action of a particular player and automatically generating a wagering option for that player based on the modification.

21. The system of claim 16, wherein the computerized multi-player game is a first person shooter and the plurality of physics based game objects are the players.

22. The system of claim 7, wherein the computerized multi-player game is a vehicle racing game and the plurality of physics based game objects are the vehicles.

23. The system of claim 7, wherein the computerized multi-player game is a ball game and the plurality of physics based game objects includes a ball and a plurality of players.

* * * * *